US006418943B1

(12) United States Patent
Miller

(10) Patent No.: US 6,418,943 B1
(45) Date of Patent: Jul. 16, 2002

(54) WASH LIQUID CIRCULATION SYSTEM FOR A DISHWASHER

(75) Inventor: Claude W. Miller, Troy, OH (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/326,303

(22) Filed: Jun. 4, 1999

(51) Int. Cl.[7] ..... B08B 15/00

(52) U.S. Cl. ..... 134/104.1; 134/104.4; 134/111

(58) Field of Search ..... 134/104.1, 109, 134/110, 111, 57 D, 58 D, 56 D, 104.4

(56) References Cited

U.S. PATENT DOCUMENTS 2,421,064 A * 5/1947 Hilliker
2,862,510 A * 12/1958 Geiger et al.
3,103,225 A 9/1963 Schmitt-Matzen ..... 134/58
3,129,711 A * 4/1964 Schmitt-Matzen
3,575,185 A * 4/1971 Barbulesco
3,836,001 A 9/1974 Heldreth ..... 210/167
4,066,552 A 1/1978 Caine ..... 210/304
4,150,680 A * 4/1979 Johnson
4,243,431 A * 1/1981 Dingler et al.
4,392,891 A * 7/1983 Meyers
4,806,135 A 2/1989 Siposs ..... 55/204
4,972,861 A * 11/1990 Milocco et al.
5,333,631 A 8/1994 Kirkland et al. ..... 134/104.1
5,345,957 A * 9/1994 Cooper et al.
5,628,334 A * 5/1997 Edwards et al.
5,643,470 A 7/1997 Amini ..... 210/787
5,762,080 A * 6/1998 Edwards et al.

* cited by examiner

*Primary Examiner*—Frankie L. Stinson
(74) *Attorney, Agent, or Firm*—Robert O. Rice; Joel M. Van Winkle; Stephen Krefman

(57) ABSTRACT

A wash liquid recirculation system for a dishwasher is provided including a unique soil separating system. The recirculation system includes a wash pump which is provided with an internal filter plate to concentrate soils. The wash pump includes an impeller disposed within a pump housing or casing. When energized, the wash pump draws wash liquid from a sump area and pumps wash liquid through the impeller into the pump housing or casing. The filter plate is disposed within the casing for dividing the casing into a first and second region and for concentrating soils in the second region. Concentrated soils are delivered from the second region to a soil collection system. The filter plate is disposed radially outwardly from the impeller, substantially perpendicular to the rotational axis of the impeller.

14 Claims, 8 Drawing Sheets

WASH LIQUID CIRCULATION SYSTEM FOR A DISHWASHER

BACKGROUND OF THE INVENTION

The present invention relates to a dishwasher wash liquid re-circulation and soil collection system, and more particularly to a system for concentrating soils in a dishwasher pump.

Typical domestic dishwashers in use today draw wash liquid from a sump at the bottom of a wash chamber and spray the wash liquid within the wash chamber to remove soils from dishes located on racks in the tub. In an attempt to improve performance and efficiency, some dishwashers employ a system for separating soil out of the recirculating wash liquid and for retaining the soils in a soil collection system. Soil collection systems frequently include a filter screen which is used to retain soil in a soil collection chamber. U.S. Pat. No. 5,165,433, for example, discloses a dishwasher system including a soil separator which sends soil laden wash liquid into a soil container whereupon the soil laden wash liquid passes through a fine filter disposed in the wall of the soil container.

In order to improve operation of soil separation systems, such as shown in the '433 patent, it is generally desirable to attempt to concentrate soils within the recirculating wash liquid, at least to some degree, such that wash liquid having a high concentration of soils can be delivered to the soil collection system. In this manner, the soil collection system is most effectively used for removing soils from wash liquid which is recirculating through the wash chamber. Without some form of soil concentration within the recirculating wash liquid, the wash liquid sent to the soil collection system includes the average concentration of soils and, as a result, it takes a relatively long time for all of the soils to be removed from the recirculating wash liquid. Moreover, it is generally true that the longer is takes to remove soils from the recirculating wash liquid, the greater the chance that the soils may be deposited on the dishes and remain on the dishes after the wash cycle is complete.

Past dishwasher systems, such as the '433 patent, have attempted to use centrifugal force to concentrated soils within a pump chamber. In such systems, a pump impeller is typically located within a circular pump chamber. As the impeller rotates, soils are urged to the outer periphery of the pump chamber under centrifugal force. Wash liquid from the outer periphery of the pump chamber, having a heavy concentration of soils, is then guided or directed to flow to a soil collection system. While a centrifugal concentrating system for concentrating soils, such as shown in the '433 patent, is relatively effective in a vertical axis type pump, it is not readily adapted to a volute type pump having a spiral casing.

It is well known that volute type pumps, wherein a centrifugal pump is housed in a spiral casing so that rotational speed will be converted to pressure without shock, are highly efficient pump designs. This type of pump is used extensively in dishwashers because of its efficiency, see for example U.S. Pat. No. 4,243,431 and U.S. Pat. No. 5,268,334. In contrast, vertical axis pump systems, where the flow of wash liquid is perpendicular to the plane in which the pump impeller rotates, such as the pump system disclosed in the '433 patent are less efficient than volute type pumps in a dishwasher.

It can be understood therefore, by one skilled in the art, that there is a need for systems to concentrate soils in recirculating wash liquid within a dishwasher. In particular, it would be an improvement to provide a soil concentration system which is readily adapted for use in a volute type pump.

SUMMARY OF THE INVENTION

The present invention, therefore, is directed to a wash liquid recirculation system for a dishwasher including a unique soil separating system. The recirculation system includes a wash pump which is provided with an internal filter plate to concentrate soils. The wash pump includes an impeller disposed within a pump housing or casing. When energized, the wash pump draws wash liquid from a sump area and pumps wash liquid through the impeller into the pump housing or casing. The filter plate is disposed within the casing for dividing the casing into a first and second region and for concentrating soils in the second region. Concentrated soils are delivered from the second region to a soil collection system. The filter plate is disposed radially outwardly from the impeller, substantially perpendicular to the rotational axis of the impeller.

According to one aspect of the present invention, the soil separating system further includes a volute pump having an impeller disposed within a spiral casing, the spiral casing having a main outlet and a secondary outlet. A filter plate is disposed within the pump housing for filtering a portion of the wash liquid pumped by the impeller through the main outlet. The filter plate is disposed radially outwardly from the impeller, substantially perpendicular to the rotational axis of the impeller. The filter plate divides the pump chamber into a first region and a second region wherein wash liquid pumped through the impeller flows into either the first region or the second region and wherein the main outlet provides an outlet for the first region and the secondary outlet provides an outlet for the second region.

According to yet another aspect of the invention, the present invention is directed to a method for separating soils from wash liquid recirculating through a wash chamber of a dishwasher. The dishwasher includes a wash pump having a pump housing and a pump impeller within the pump housing. A filter plate separates the pump housing into a first region having a main outlet and a second region having a secondary outlet. During operation of the dishwasher, wash liquid is drawn from the sump area of the wash chamber into the pump housing and pumped through the impeller into either the first or second region. Some of the wash liquid pumped into the second region is passed through the filter plate into the first region for outlet through the main outlet while another portion wash liquid, including the soils concentrated in the second region, are pumped through the secondary outlet to a soil collection system.

DETAILED DESCRIPTION OF THE PREFERRED EMBODIMENTS

Figure 1:
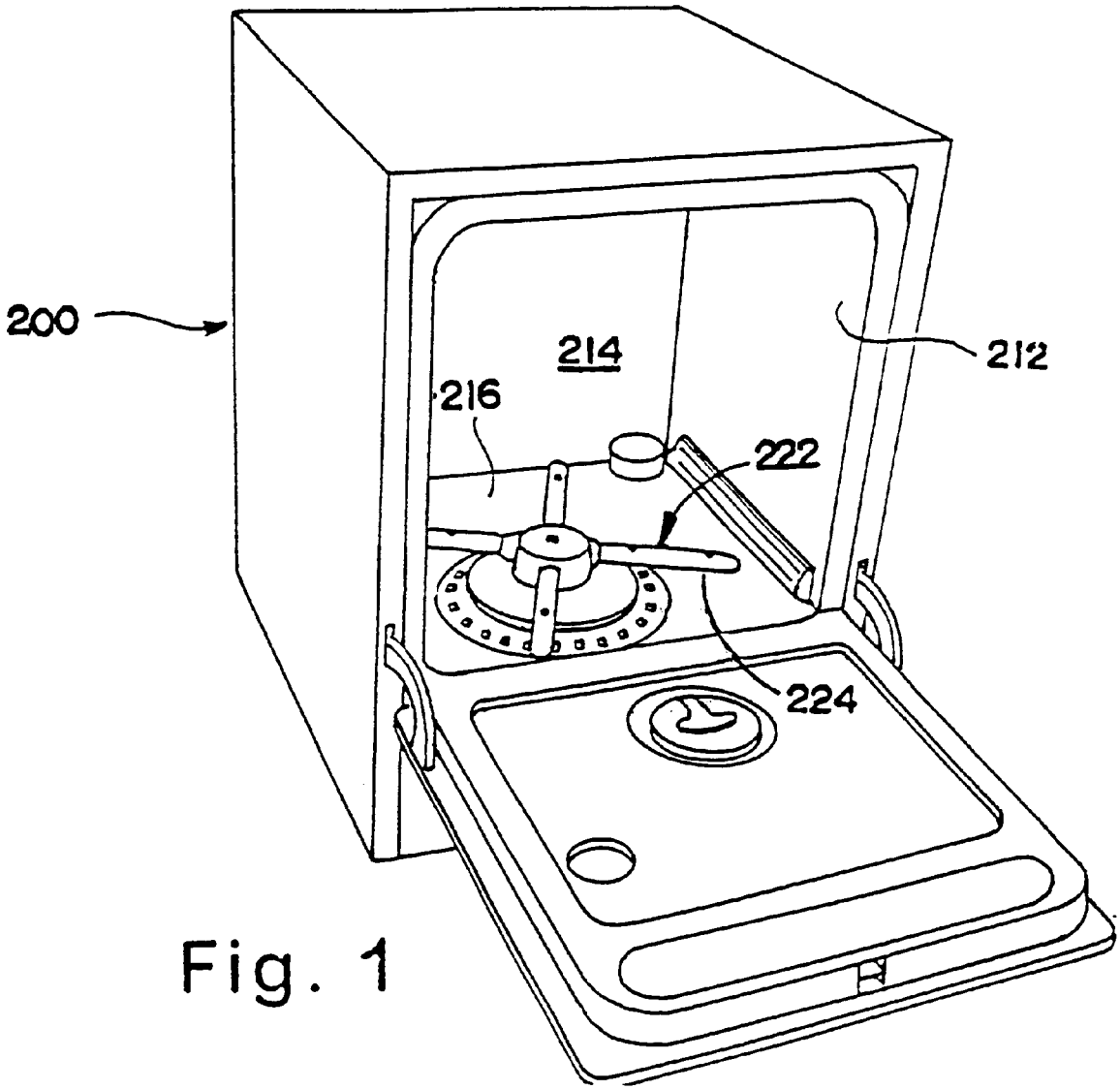
FIG. 1 is a perspective view of a dishwasher including a recirculation and soil separation system in accordance with the present invention.
Figure 2:
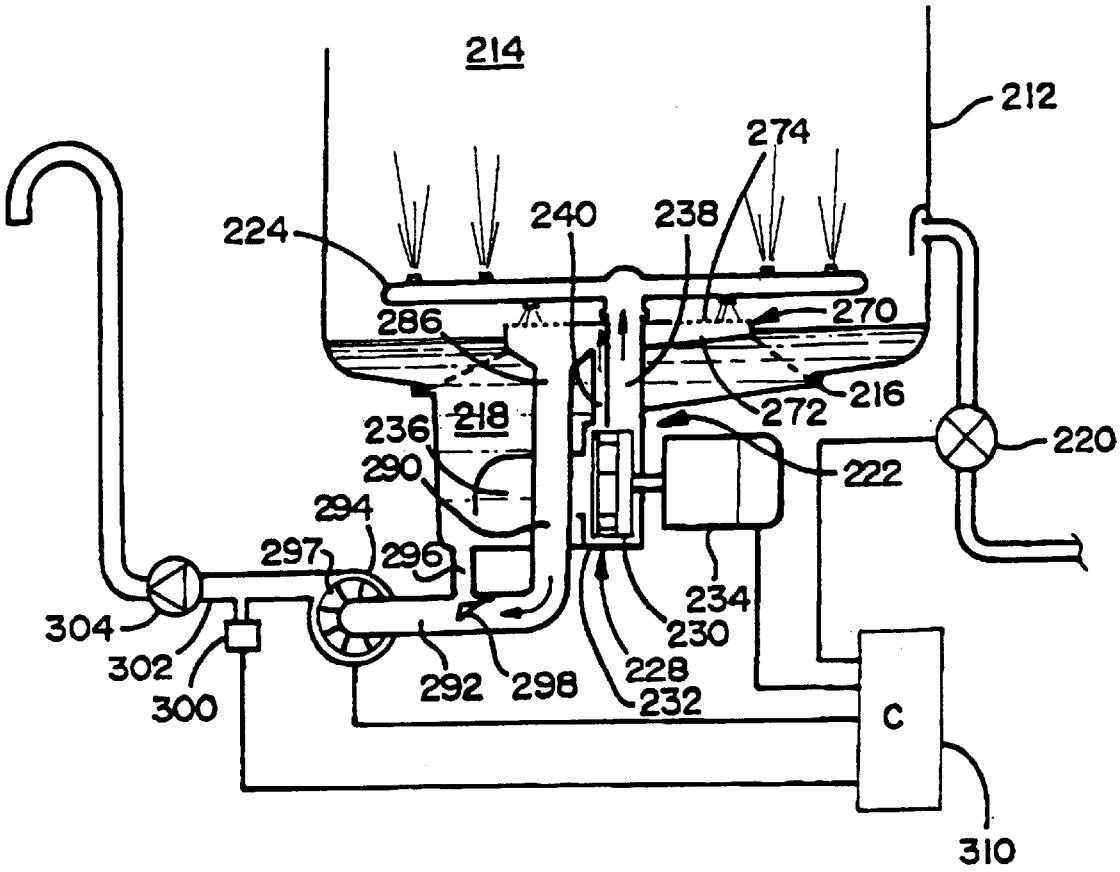
FIG. 2 is a schematic illustration of the pump and soil separation and collection system of the present invention in accordance with the present invention shown in FIG. 1.

In accordance with the invention as shown in the drawings, and particularly as shown in FIGS. 1 and 2, an automatic dishwasher generally designated 200 includes an interior tub 212 forming an interior wash chamber or dish-washing space 214. The wash tub 212 includes a bottom wall 216 having a downwardly sloped portion which defines a lower tub region or sump 218 for receiving wash liquid inlet into the tub 212 through a fill valve 220. A soil separator and pump assembly 222 is located in the sump 218 for recirculating wash liquid from the sump 218 through the tub 212. A wash arm assembly 224 is provided above the pump assembly 222 and receives wash liquid from the pump system 222.

The basic constructional features of the soil separator are explained in U.S. Pat. No. 5,803,100, to Thies, entitled "SOIL SEPARATION CHANNEL FOR A DISHWASHER PUMP SYSTEM", herein incorporated by reference. In that application, the operation of a centrifugal soil separator and the construction of a soil separator and collector are fully explained.

The soil separator/pump assembly 222 includes a highly efficient volute pump 228. The volute pump 228 is a centrifugal pump having a wash impeller 230 rotated about a horizontal axis within a pump chamber 232 which defines a spiral casing such that speed will be converted to pressure without shock within the pump chamber. During a wash cycle, the wash impeller 230, driven by motor 234, draws wash liquid from the sump. 218 through a pump inlet 236 and pumps the wash liquid out through a main outlet 238 and a secondary outlet 240. Wash liquid pumped through the main pump outlet 238 is directed to flow into the lower spray arm 224. Wash liquid flowing through the secondary outlet is directed to flow into a soil collector 270. Wash liquid is repeatedly recirculated throughout the wash tub 212 for removing soils from dishware supported therein.

Figure 3:
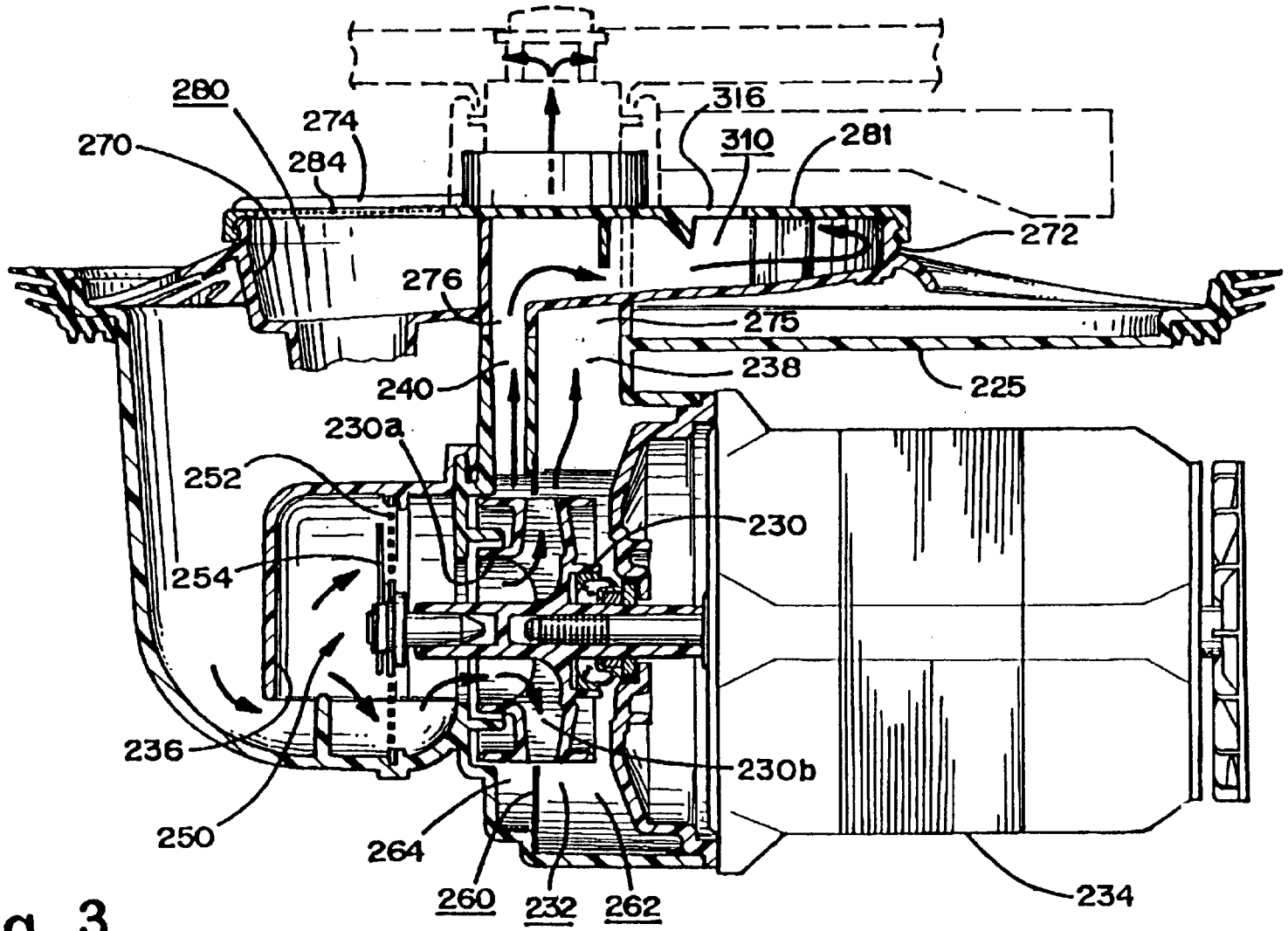
FIG. 3 is a sectional view of the pump and soil separation system of the present invention, illustrating fluid flow through the wash pump and into the soil collector.
Figure 4:
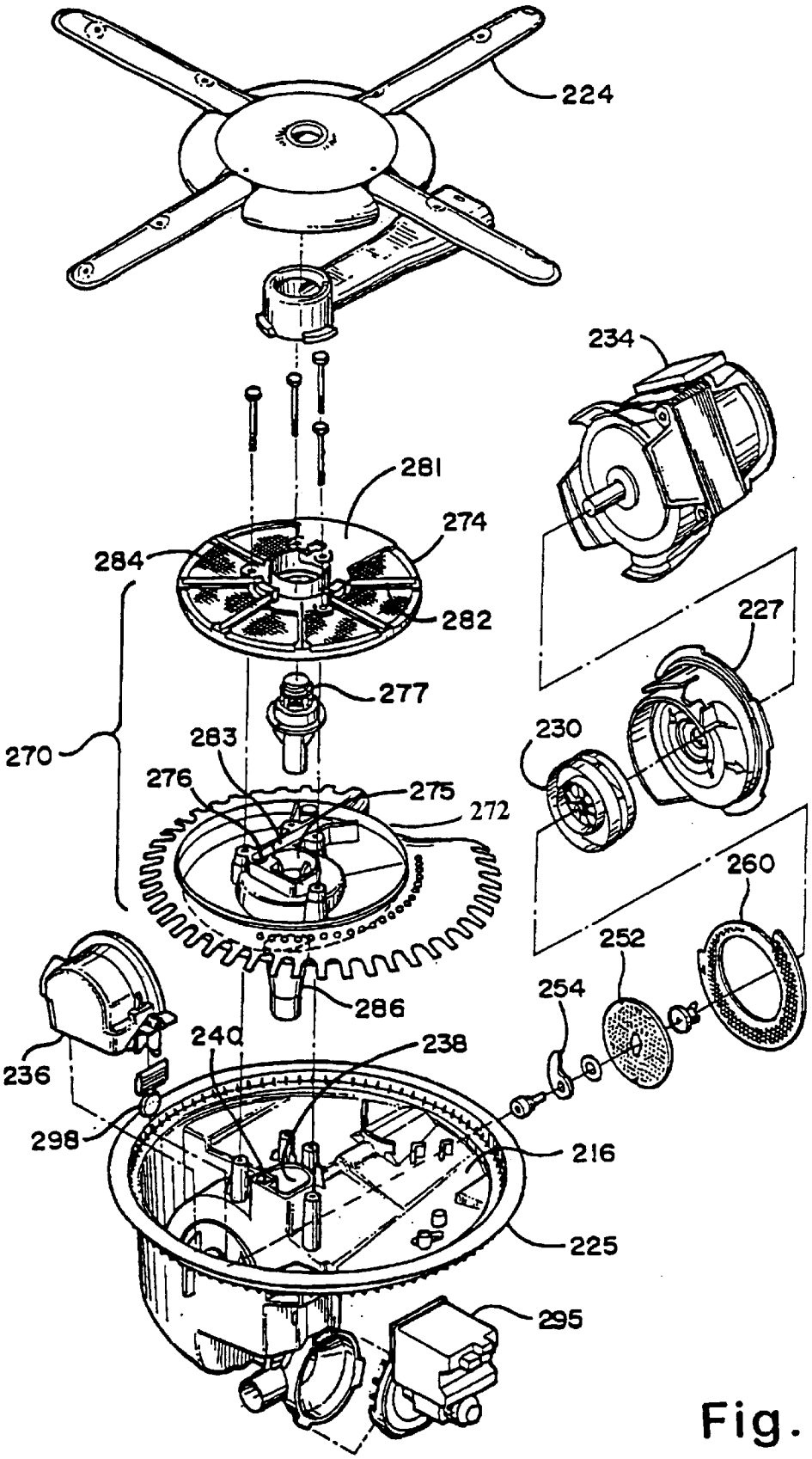
FIG. 4 is an exploded, perspective view of the pump and soil separation system of the present invention.

As best understood by referring to FIGS. 3 and 4, in combination with FIG. 2, it can be understood that the pump chamber 232, the pump inlet 236, the main outlet 238 and the secondary outlet 240 can be formed in part by a member 225 which forms part of the tub bottom 216. A volute member 227 may further contribute toward forming the pump chamber 232, the main outlet 238 and the secondary outlet 240. While this structure is shown as a particular embodiment of the invention, it is clearly just one example of how the present invention may be practiced.

Wash liquid drawn into the pump inlet 236 passes through a chopper assembly 250. The chopper assembly includes a sizing plate 252 and a chopper blade 254. The chopper blade 254 rotates adjacent the sizing plate 252 and chops food particles entrained within the wash liquid to size sufficient to allow the food particles to pass through the sizing plate. After being chopped and sized by the chopper assembly 250, the soils are drawn, along with the wash liquid, into the pump chamber 232.

Within the pump chamber 232, the soils are partially separated and concentrated by the operation of a filter plate 260 located within the pump chamber 232. The filter plate 260 is a flat filter with an inner diameter (I.D.) greater than the outer diameter (O.D.) of the wash impeller 230 and which is located about the wash impeller 230 perpendicular to the axis of rotation of the wash impeller 230. The filter plate 260 separates the pump chamber into first region or side 262 and a second region or side 264. During the dishwasher operation, wash liquid is drawn through the pump inlet 236, into the eye of the wash impeller 230*a*, and is moved outwardly from the center of the impeller 230 by the impeller vanes 230*b*.

Wash liquid coming off of the impeller 230 is divided into two portions by the filter plate 260 such that a first portion passes from the impeller into the first region 262 of the pump chamber 232 and a second portion passes from the impeller into the second region 264 of the pump chamber 232. The main outlet 238 provides an outlet for the first region 262 of the pump chamber 232. The secondary outlet 240 provides an outlet for secondary region 264 of the pump chamber 232. The secondary outlet 240 is sized relatively small such that when the wash impeller 230 is pumping wash liquid, the pressure in second region 264 of the pump chamber 232 is greater than the pressure in the first region 262 of the pump chamber 232. The pressure difference across the filter plate 260 is caused by the fact that the ratio of the first portion of wash liquid pumped from the impeller 230 into the first region 262 to the second portion of wash liquid pumped from the impeller 230 into the second region 264 is greater than the ratio of the size of the main outlet 238 to the size of the secondary outlet 240.

It can be understood, therefore, that a portion of the wash liquid coming off the wash impeller 230 into the second region 264 of the pump chamber 232 passes through the secondary outlet 240 and the remainder passes through the filter plate 260 traveling from the second region 264 of the pump chamber 232 into the first region 262 of the pump chamber 232. This flow through the filter plate 260 from the second region 264 to the first region 262 results in the filtering of soils and a concentrating of soil in the second region 264 such that the wash liquid sent through the secondary outlet 240 has a concentration of soils greater than the concentration of soils in the wash liquid being drawn into the eye of the pump impeller, at least for a first portion of the wash cycle.

Wash liquid and entrained soils flow, therefore, through the secondary outlet 240 into the soil collector 270. As shown in FIG. 4, the soil collector includes a main body 272 and a top panel 274. The main body 272 is a generally circular, cup-like member which is secured to the bottom wall 216 of the wash tub 212. The main body 272 includes an outer flange which forms a coarse grate through which wash liquid flows on its path toward the pump inlet 236. The main body 272 has a center opening or conduit 275 which receives fluid flow from the main outlet 238 of the pump chamber 232. A bearing hub 277 may be partially positioned in the center conduit 275 for directing wash liquid to the spray devices 224. The main body further includes an inlet 276 for receiving wash liquid from the secondary outlet 240.

Figure 6:
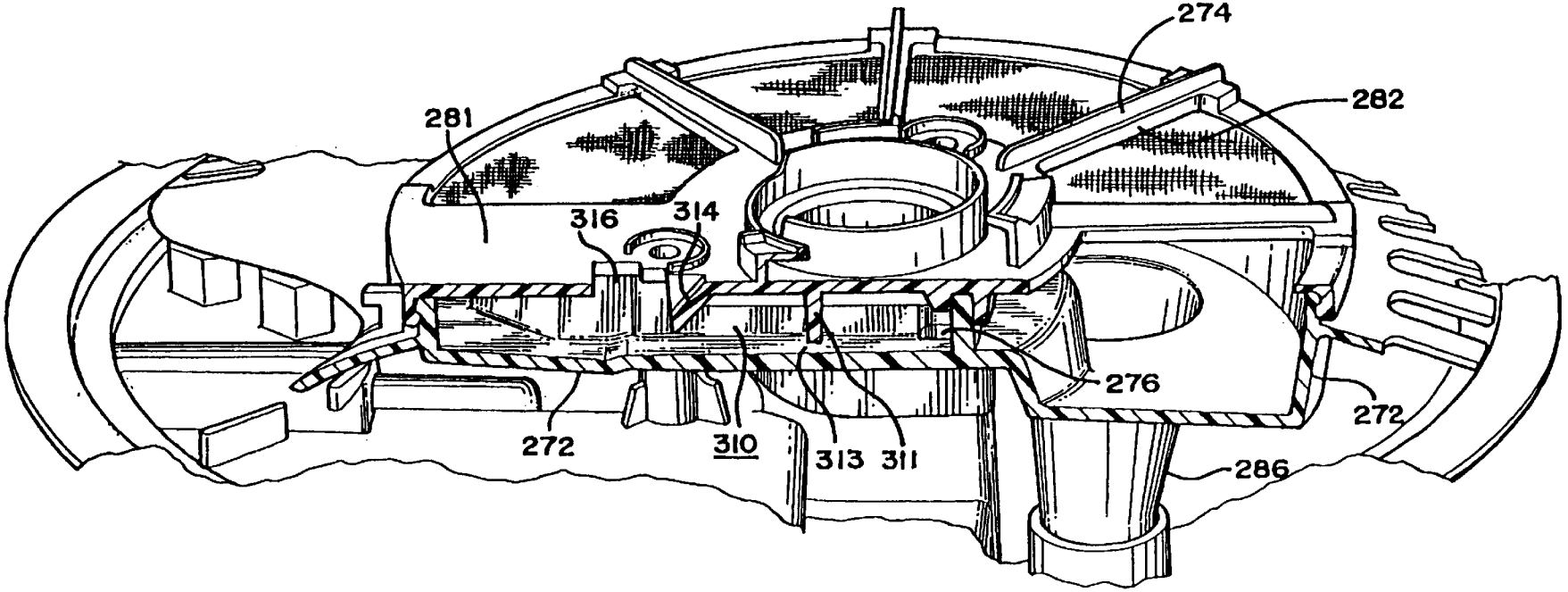
FIG. 6 is a cross-sectional view taken along lines VI—VI of FIG. 5 showing the inlet conduit into the soil separation channel.

The top panel 274 forms a top wall of the soil collector 270. The top panel 274 has a solid wall portion 281 which overlies the inlet 276. The solid wall portion 281 and a channel 283 in the main body 272 combine to form an inlet conduit or path 310 (FIG. 6). The top panel 274 further includes a plurality of openings 282 which are provided with filter screen panels 284. The portion of the top panel 274 which includes a plurality of openings 282 combines with the main body 272 for forming a soil separation channel 280.

Wash liquid flowing through the secondary outlet 240 is received into the soil collector 270 through the inlet 276 and is directed to pass through the inlet conduit or path 310 formed between the main body 272 and the top panel 274. After passing through the inlet conduit 310, the wash liquid is directed to flow into the soil separation channel 280 formed between the main body 272 and the top panel 274. The separation channel 280 is provided about the center opening 275 but could be in different configurations, including a linear configuration. Many of the constructional features of the separation channel are explained in U.S. Pat. No. 5,803,100.

The main body 272 further includes a downwardly projected portion 286 which defines a soil accumulation region or sump 288 for the soil collector 270. As the soil laden wash liquid proceeds within the separation channel 280, water passes upwardly through the filter screen panel 284 leaving the soils within the separation channel 280. Within the soil separation channel 280, soils are directed to generally accumulate in the soil accumulation region or sump 288.

Figure 5:
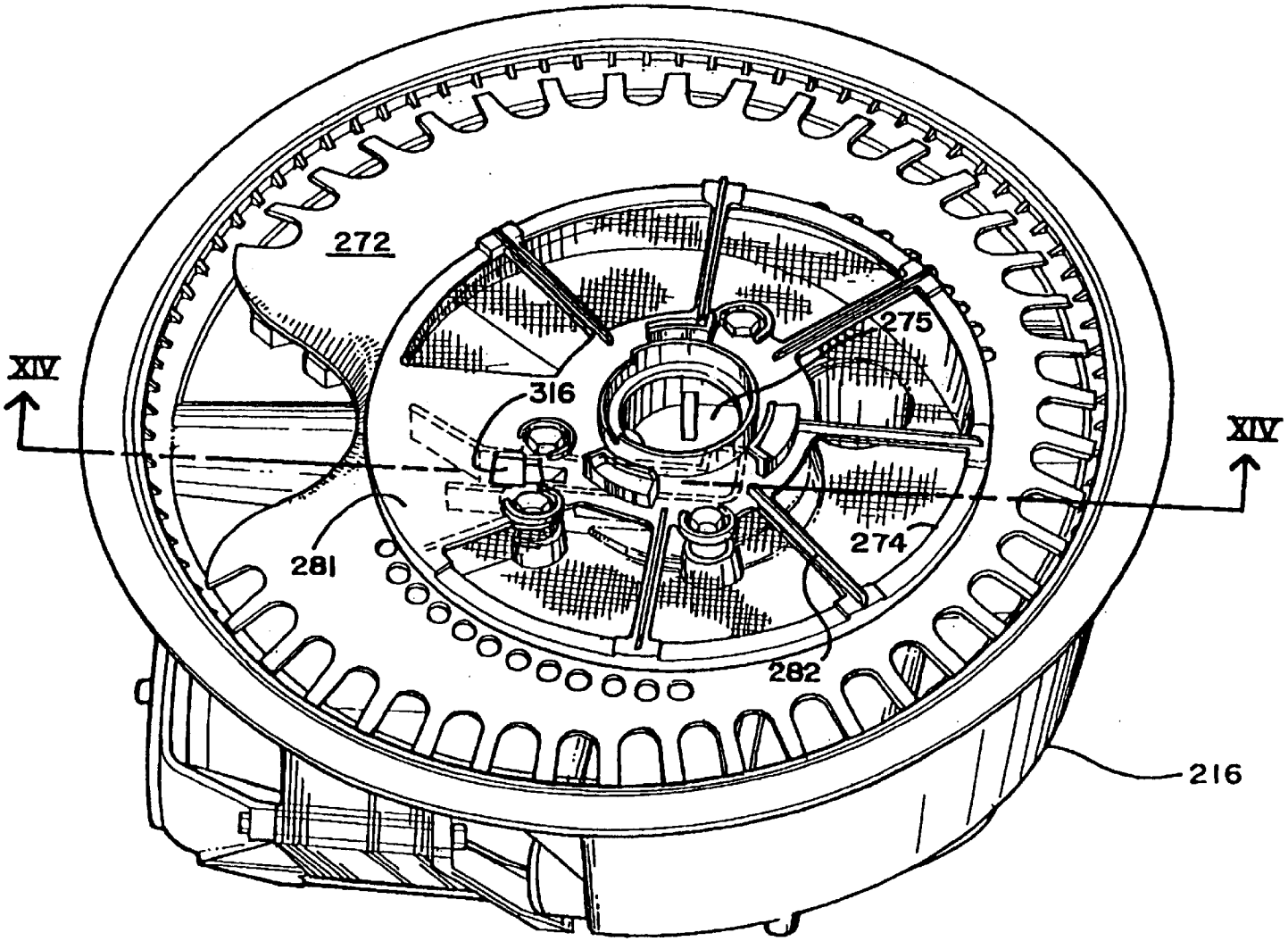
FIG. 5 is a perspective view of the pump and soil separation system of the present invention.

The flow of the wash liquid into the soil collector 270 can be better understood by referring now to FIGS. 5 and 6. FIG. 6, in particular, shows details of an example of a possible inlet conduit 310. As described above, wash liquid flows from the inlet 276 through the inlet conduit 310 and passes into the separation channel 280. A rib 311 in the inlet conduit 310 forms a set orifice 313 through which wash liquid must flow to enter the separation channel 280 for limiting the amount of flow and increasing the pressure/velocity being delivered to the separation channel 280. In one embodiment, an angled wall section 314 is provided in the inlet conduit 310 immediately upstream of an opening or second outlet 316 provided in the solid wall portion 281. The angled wall section 314 forms a venturi in the inlet conduit 310 to increase the speed of the wash liquid for forming a jet and to deflect the wash liquid flow through the inlet conduit 310 to insure the jet is directed past the opening 316 in the inlet conduit. Accordingly, due to the angle and velocity of the wash liquid, a slight suction may be generated at the opening 316.

In a normal wash mode, the present invention operates to send wash liquid through the inlet conduit 310 such that soils may be stored in the soil collector 270. However, it is possible that the soil collector 270 may become filled with soils such that further wash liquid can not be supplied therein due to the clogging of the filter screens 284 with soils. When this occurs, the soil collector 270 will become pressurized as discussed above. According to the present invention, the pressure generated by the overloaded or clogged filter screens 284 will cause the wash liquid flowing in the inlet conduit 310 to be redirected out of the soil collector 270 through the opening 316. It can be appreciated that the soils already captured in the soil collector 270 remain in the soil collector 270. The pump system may remain operating in this mode until the filter screen panels 284 are either cleaned by back-wash nozzles or by a full or partial drain of the system.

It can be appreciated that the design of a venturi inlet system for a soil collector is a delicate balancing act between the many interconnecting flow paths. For instance, in order for soils not to be lost from the soil collector 270 when the filter screens are clogged, the pressure into the soil collector 270 must be enough to prevent the back wash nozzles from generating an additional flow through the opening 316. Also, the venturi must be sized so as to relieve the build-up of pressure prior to it overcoming the drain loop on the exterior of the dishwasher, which prevents the pumping of water down the drain line during the wash cycle. A standpipe (not shown) internal to the dishwasher tub may be provided as an alternative to the venturi. If a standpipe is used as part of the inlet to the soil collector 270, instead of having the design of the venturi regulating when the system stops collecting soils, the height of standpipe path performs this function.

The second outlet 316, therefore, provides a soil collector bypass system when the filter screens 284 are clogged. This bypass system is particularly useful for an embodiment of the present invention which does not include automatic purging of the soil collector. However, the bypass system may also be employed with an automatic purge type system, as will described hereinbelow.

Figure 7:
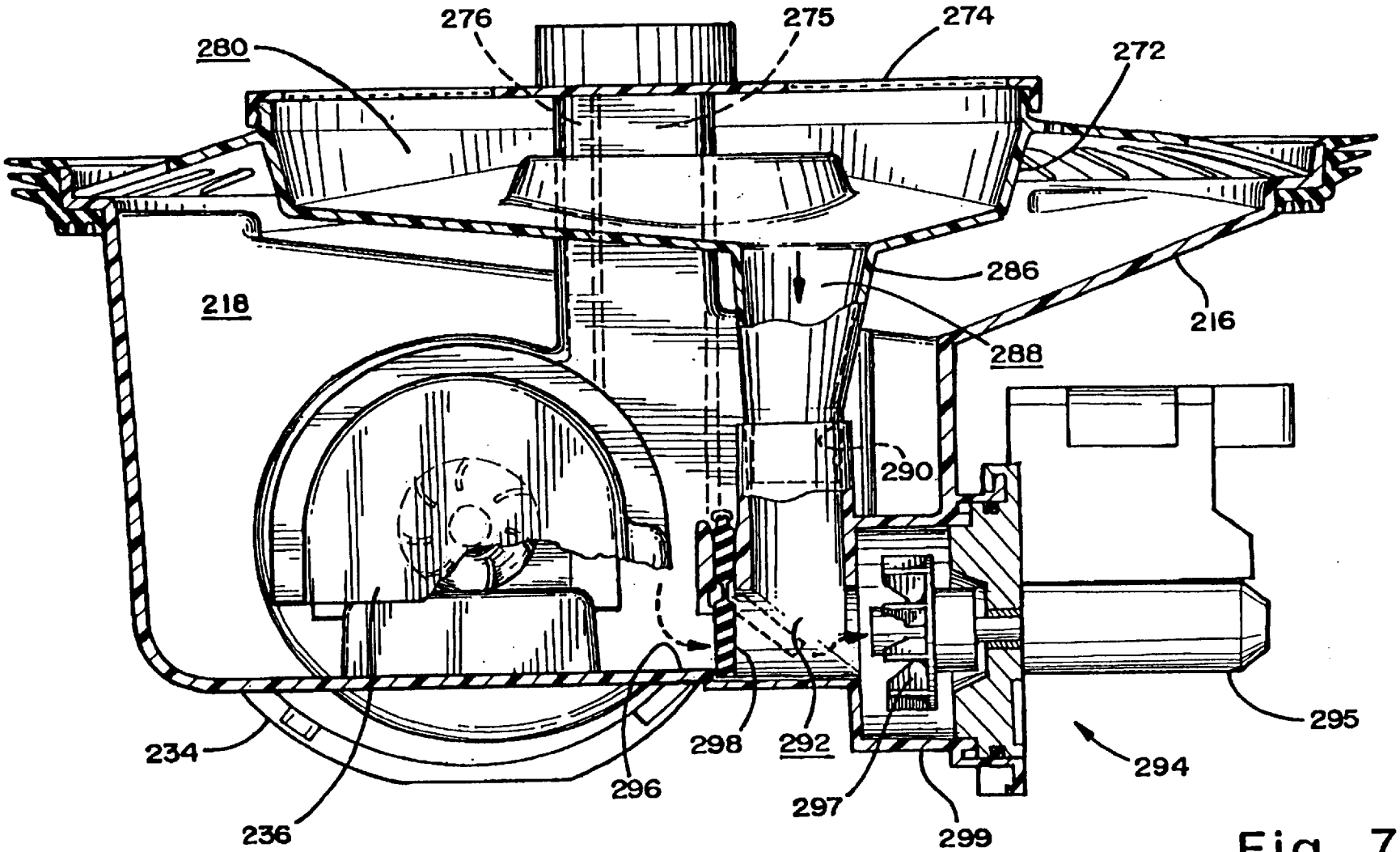
FIG. 7 is a sectional view of the pump and soil separation system shown in FIG. 2, illustrating fluid flow from the soil collector into the drain pump.

As shown in FIG. 7 and in FIG. 2, a drain pump 294, separate from the wash pump 228, is provided for draining wash liquid from the dishwasher tub 212. The drain pump 294 includes a drain motor 295 drivingly connected to a drain impeller 297 located within a housing 299. Located at the bottom of the downwardly projected portion 286 is an outlet opening 290 which is fluidly connected with an inlet area 292 for the drain pump 294. An opening 296 is also provided into the inlet area 292 from the sump 218. A flapper type check valve 298 is provided at the opening 296 for selectively controlling the flow of liquid from the sump 218 into the inlet area 292 of the drain pump 294 based on the pressure difference across the valve 298. Preferably, when the wash pump 228 is operating, pumping fluid into the soil collector 270 and pressurizing the inlet area 292, the pressure in the inlet area 292 will be greater than the sump 218 such that the valve 298 will be closed. When the wash pump 228 is not pressurizing the inlet area 292, the flapper may open to allow wash liquid to flow from the sump 218 into the inlet area 292.

During the wash cycle, the filter screen panels 284 are repeatedly backflushed. As the lower wash arm 224 rotates, pressurized wash liquid is emitted from downwardly directed backflush nozzles. Means may be provided for forming a fan-shaped spray from the flow of wash liquid through the backflush nozzles. As the lower wash arm rotates, this fan shaped spray sweeps across the filter screens 284 providing a backwashing action to keep the screen clear of soil particles which may impede the flow of cleansed wash liquid into the sump 18. As described above, in spite of backflushing, in conditions of a heavy soil load, the filter screen panels 284 may become clogged with food soils. When this occurs, wash performance is impaired and pressure within the soil collector 270 may increase to an undesirable level.

To address the problem of the filter screen panels becoming clogged with food soils, the present invention discloses a system for periodically purging the soil collector 270 to avoid the problems of filter screen clogging. The basic principle of the purging system is to purge the soil collector 270 in response to pressure within the soil collector 270. To that end, a pressure sensor 300 is provided for monitoring the pressure within the soil collector 270. The pressure sensor is shown in FIG. 2 as being mounted on a drain line 302 downstream of the drain pump 294 but upstream of a drain check valve 304. The pressure sensor 300, however, could alternatively be located upstream of the drain pump 294 on the inlet area 292, the accumulator region 288 or in the separation channel 280. The pressure sensor 52 can be either an analog device or a digital device.

During the wash mode when the wash pump 228 is recirculating wash liquid through the tub 212, the drain pump 294 is energized to clear the soil collector 270 and filter screen panels 284 when the pressure in the soil collector 270 exceeds a predetermined limit pressure, indicative of a clogged filter screens 284. This operation of the drain pump 294 to clear the soil collector 270 while the wash pump 228 continues to recirculate is referred to as purging or a purging operation. During the purging operation, the drain pump 294 is energized while the wash pump 228 continues to recirculate wash liquid through the tub 212.

As shown in FIG. 2, a controller 310 is operatively connected to the drain pump 294, the wash pump motor 234, the pressure sensor 300 and the fill valve 220 for operating the dishwasher in accordance with the present invention and, in particular, to operate the dishwasher to perform the purging operations. The controller 310 is an electromechanical controller or a microprocessor based programmable controller—both of which are known in the prior art.

Figure 8:
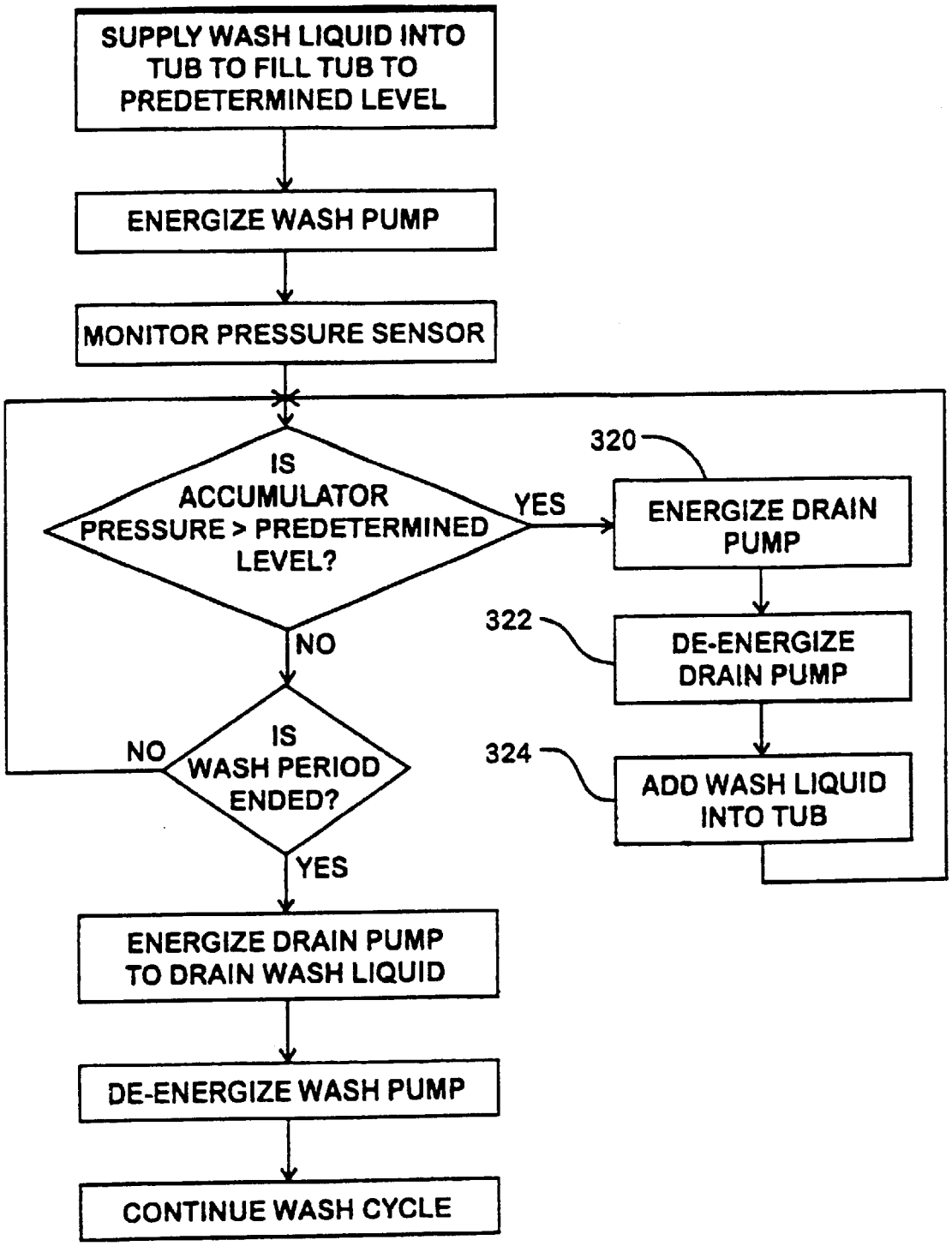
FIG. 8 is a flow chart illustrating the operation of the dishwasher of the present invention.

In operation, as shown in FIG. 8, after fill liquid is initially supplied into the tub 212 and the wash pump 228 is energized, the pressure sensor 300 is monitored. If the pressure sensor 300 provides a signal to the controller 310 indicating that the pressure within the soil collector 270 exceeds a predetermined limit, the drain pump motor 295 is energized for drawing wash liquid, highly concentrated with soils, from the soil accumulator region 288, through drain pump inlet area 292 and pumping the wash liquid to drain past the check valve 304, as shown at step 320. The drain pump 294 may operate for a preselected period of time —such as 5 seconds. After the 5 seconds, the drain pump 294 is de-energized, shown at step 322. Fill liquid may be added to the tub 212 to replace the purged wash liquid, step 324. After a period of time which allows the pressure within the soil separator to equalize, the pressure sensor 300 may be again monitored to determine if the pressure within the soil collector 270 exceeds a predetermined limit.

The purging operation can be repeated if the pressure sensor again senses a pressure within the soil collector 270 which exceeds the predetermined limit, the drain pump will be energized for a period of time. During a wash period of the dishwasher cycle, the soil collector 270 may be repeatedly purged in this manner. If however, the number of purges exceeds some predetermined number, the controller may be programmed to drain the entire dishwasher and refill the dishwasher with completely fresh water.

During each purging operation, it is desirable that the drain pump 294 operate to purge wash liquid from just the soil collector 270. To this end, the flapper valve 298 is designed to prevent wash liquid from flowing from the sump 218 into the inlet area 292 during the purging operations. However, some small amount of wash liquid flowing from the sump 218 into the inlet area 292 and from there to drain during purging can readily be tolerated. Since the drain pump 294 is operated for such a short time during purging, leakage from the sump into the drain pump 294 during purging will not significantly affect the efficiency of the present invention. In fact, it can be understood that present invention can be practiced in dishwasher designs wherein wash liquid is drained from the sump 218 during the purging operation through both the soil collector outlet opening 290 and the sump opening 296.

It can be appreciated that if the pressure sensor 300 is moved upstream of the drain pump, the drain pump may be energized during a purging operation when the pressure within the soil collector 270 exceeds a predetermined limit and the drain pump 294 can be de-energized when the pressure in the accumulator is lowered below the predetermined limit pressure the drain pump 294.

It can be seen, therefore, that the present invention is directed to a unique pump and soil collection system for a dishwasher. In particular, the present invention provides a unique pump system for use in a dishwasher wherein a highly efficient volute type pump is combined with a superior soil separation system. The present invention provides for a filter screen located within the volute pump which increase the concentration of soils sent to the soil collection chamber.

As is apparent from the foregoing specification, the invention is susceptible of being embodied with various alterations and modifications which may differ particularly from those that have been described in the preceding specification and description. It should be understood that the inventor wishes to embody within the scope of the patent warranted hereon all such modifications as reasonably and properly come within the scope of our contribution to the art.

I claim:

1. A water circulation system for a dishwasher having a wash chamber, the system spraying wash liquid within the wash chamber for cleaning soils from objects supported within the wash chamber, the water circulation system comprising:

a wash pump having a pump housing and a pump impeller within the pump housing, the pump housing having a main outlet and a secondary outlet;

a wash arm supported within the washing chamber fluidly connected with the main outlet for receiving wash liquid from the wash pump such that wash liquid is sprayed within the wash chamber for recirculating wash liquid throughout the wash chamber;

a soil collector including a filter, the soil collector fluidly connected with the secondary outlet; and a screen disposed within the pump housing about the pump impeller substantially perpendicular to the rotational axis of the impeller for directing soils to flow through the secondary outlet into the soil collector.

2. The water circulation system of claim 1, wherein the screen is disposed about the impeller and divides the pump chamber into a first region and a second region wherein wash liquid pumped through the impeller flows into either the first region or the second region, wherein the main outlet provides an outlet for the first region and the secondary outlet provides an outlet for the second region.

3. A water circulation system for a dishwasher having a wash chamber, the system spraying wash liquid within the wash chamber for cleaning soils from objects supported within the wash chamber, the water circulation system comprising:

a wash pump having a pump housing and a pump impeller within the pump housing, the pump housing having a main outlet and a secondary outlet;

a wash arm supported within the washing chamber fluidly connected with the main outlet for receiving wash liquid from the wash pump such that wash liquid is sprayed within the wash chamber for recirculating wash liquid throughout the wash chamber;

a soil collector including a filter, the soil collector fluidly connected with the secondary outlet; and a screen disposed within the pump housing about the pump impeller and divides the pump chamber into a first region and a second region wherein wash liquid pumped through the impeller flows into either the first region or the second region, wherein the main outlet provides an outlet for the first region and the secondary outlet provides an outlet for the second region for directing soils to flow through the secondary outlet into the soil collector.

4. The water circulation system of claim 3, wherein only a portion of wash liquid pumped through the impeller into the second region flows through the secondary outlet, the portion of wash liquid pumped into the second region which does not flow through the secondary outlet passes through the screen into the first region for outlet through the main outlet.

5. A water circulation system for a dishwasher having a wash chamber, the system spraying wash liquid within the wash chamber for cleaning soils from objects supported within the wash chamber, the water circulation system comprising:

a volute wash pump having a pump housing that forms a spiral casing and a pump impeller within the pump housing, the pump housing having a main outlet and a secondary outlet;

a wash arm supported within the washing chamber fluidly connected with the main outlet for receiving wash liquid from the wash pump such that wash liquid is sprayed within the wash chamber for recirculating wash liquid throughout the wash chamber;

a soil collector including a filter, the soil collector fluidly connected with the secondary outlet; and a screen disposed within the pump housing about the pump impeller and along a portion of the spiral casing beyond the wash impeller for directing soils to flow through the secondary outlet into the soil collector.

6. The water circulation system of claim 5, wherein the screen forms an inlet region located adjacent the pump housing such that wash liquid adjacent the pump housing wall is directed into the inlet region and the secondary outlet provides an outlet for the inlet region.

7. A soil separation system for a dishwasher having a wash chamber, the soil separation system comprising:

a volute pump having an impeller disposed within a spiral casing, the spiral casing having a main outlet and a secondary outlet; and a filter plate disposed radially outwardly from the impeller, substantially perpendicular to the rotational axis of the impeller within the pump housing for filtering a portion of the wash liquid pumped by the impeller through the main outlet.

8. A soil separation system for a dishwasher having a wash chamber, the soil separation system comprising:

a volute pump having an impeller disposed within a spiral casing, the spiral casing having a main outlet and a secondary outlet; and a filter plate disposed about the impeller within the pump housing for filtering a portion of the wash liquid pumped by the impeller through the main outlet, said filter plate dividing the pump chamber into a first region and a second region, wherein wash liquid pumped through the impeller flows into either the first region or the second region, and said main outlet provides an outlet for the first region and the secondary outlet provides an outlet for the second region.

9. The water circulation system of claim 8, wherein only a portion of wash liquid pumped through the impeller into the second region flows through the secondary outlet, the portion of wash liquid pumped into the second region which does not flow through the secondary outlet passes through the screen into the first region for outlet through the main outlet.

10. A soil separation system for a dishwasher having a wash chamber, the soil separation system comprising:

a volute pump having an impeller disposed within a spiral casing, the spiral casing having a main outlet and a secondary outlet; and a filter plate disposed within the pump housing along a portion of the spiral casing beyond the wash impeller for filtering a portion of the wash liquid pumped by the impeller through the main outlet.

11. The water circulation system of claim 10 wherein the screen forms an inlet region located adjacent the pump housing such that wash liquid adjacent the pump housing wall is directed into the inlet region and the secondary outlet provides an outlet for the inlet region.

12. A dishwasher having a tub forming an interior wash chamber including a bottom wall, the tub receiving wash liquid from an water inlet, the dishwasher comprising:

a sump region defined by the bottom wall of the wash chamber;

a volute pump connected to the bottom wall for recirculating wash liquid throughout the wash chamber, the volute pump having an impeller and a casing surrounding the impeller, the impeller having vanes disposed about an eye and being rotated such that wash liquid is drawn from the sump into the eye of the impeller and pumped outwardly through the vanes, the casing having a main pump outlet and a secondary pump outlet;

a wash arm positioned above the volute pump for receiving wash liquid from the volute pump through the main pump outlet and spraying wash liquid within the tub;

a soil collector disposed below the wash arm, the soil collector receiving wash liquid from the volute pump through the secondary pump outlet, the soil collector further having a drain outlet; and a filter plate disposed within the casing separating the casing into a first region and a second region such that soils are concentrated in the second region and pumped to the soil collector through the secondary pump outlet.

13. The dishwasher according to claim 12, wherein the filter plate is disposed about the impeller, substantially perpendicular to the rotational axis of the impeller.

14. The dishwasher according to claim 12, wherein the filter plate is disposed downstream from the impeller.

* * * * *